US006960239B2

(12) United States Patent
Bilodeau et al.

(10) Patent No.: US 6,960,239 B2
(45) Date of Patent: Nov. 1, 2005

(54) PROCESS AND APPARATUS FOR ADDING PARTICULATE SOLID MATERIAL TO MOLTEN METAL

(75) Inventors: Jean-François Bilodeau, Jonquière (CA); Laszlo Istvan Kiss, Chicoutimi (CA); Carl Lakroni, Chicoutimi (CA)

(73) Assignee: Alcan International Limited, Montreal (CA)

( * ) Notice: Subject to any disclaimer, the term of this patent is extended or adjusted under 35 U.S.C. 154(b) by 253 days.

(21) Appl. No.: 10/454,087

(22) Filed: Jun. 3, 2003

(65) Prior Publication Data

US 2003/0205854 A1 Nov. 6, 2003

Related U.S. Application Data

(62) Division of application No. 09/950,443, filed on Sep. 10, 2001, now Pat. No. 6,589,313.
(60) Provisional application No. 60/232,071, filed on Sep. 12, 2000.

(51) Int. Cl.[7] ..... C22B 9/05
(52) U.S. Cl. ..... 75/414; 75/683; 266/226
(58) Field of Search ..... 75/414, 683; 266/226

(56) References Cited

U.S. PATENT DOCUMENTS

| | | | | |
|---|---|---|---|---|
| 2,089,742 A | * | 8/1937 | Garwin | 75/683 |
| 3,227,547 A | | 1/1966 | Szekely | 75/59 |
| 3,849,119 A | | 11/1974 | Bruno et al. | 75/68 |
| 4,618,427 A | | 10/1986 | Venas | |
| 4,673,434 A | | 6/1987 | Withers et al. | 75/61 |
| 5,342,429 A | | 8/1994 | Yu et al. | 75/680 |
| 5,616,167 A | | 4/1997 | Eckert | 75/678 |
| 6,060,013 A | | 5/2000 | Le Brun et al. | 266/217 |
| 6,106,588 A | * | 8/2000 | Skibo et al. | 75/684 |
| 6,589,313 B2 | * | 7/2003 | Bilodeau et al. | 75/414 |
| 6,602,318 B2 | * | 8/2003 | Bilodeau et al. | 75/414 |
| 2002/0096810 A1 | * | 7/2002 | Bilodeau et al. | 266/217 |

FOREIGN PATENT DOCUMENTS

| | | | | |
|---|---|---|---|---|
| CA | 2272976 | | 5/1999 | |
| EP | 395 138 | | 10/1990 | |
| EP | 396 267 | | 11/1990 | |
| EP | A1 0 753 589 | | 1/1997 | |
| GB | 1422055 | | 1/1976 | |
| GB | 2041982 | * | 9/1979 | 75/683 |
| JP | 62-14125 | | 7/1988 | |
| JP | 4051177720 A | * | 5/1993 | 266/235 |

* cited by examiner

*Primary Examiner*—Melvyn Andrews
(74) *Attorney, Agent, or Firm*—Cooper & Dunham LLP

(57) ABSTRACT

An apparatus is provided for the treatment of molten metal, e.g. aluminum, with a particulate treatment agent and a gas. This includes a vessel for holding molten metal, a rotary device for breaking up particulate treatment agent and gas within the molten metal and for dispersing particulate treatment agent and gas within the molten metal contained in the vessel and means for supplying the particulate treatment agent and gas to the rotary device. The rotary device includes a hollow shaft having a rotor with an axial opening fixed to the discharge end of the shaft, this rotor being in the form of an annular plate with a plurality of radially mounted upwardly directed blades projecting from the top face of the annular plate and a plurality of radially mounted downwardly directed blades projecting from the bottom face of the annular plate.

19 Claims, 4 Drawing Sheets

PROCESS AND APPARATUS FOR ADDING PARTICULATE SOLID MATERIAL TO MOLTEN METAL

CROSS REFERENCE TO RELATED APPLICATIONS

This application is a division of U.S. patent application Ser. No. 09/950,443, filed Sep. 10, 2001 (now U.S. Pat. No. 6,589,313), which claims the priority benefit under 35 U.S.C. §119(e) of U.S. provisional patent application No. 60/232,071 filed Sep. 12, 2000.

FIELD OF THE INVENTION

This invention relates to a process and apparatus for the treatment of molten metals and, more particularly, the addition of salt flux to aluminum in melting and holding furnaces. It claims the benefit of Provisional Application Ser. No. 60/232,071, filed Sep. 12, 2000.

BACKGROUND OF THE INVENTION

Treatment of molten aluminum by gases and more recently by salt fluxes in large melting and holding furnaces incorporating stirring of the molten metal has been proposed. A typical embodiment of such a device is described in the article "Theoretical and Experimental Investigation of Furnace Chlorine Fluxing" by Celik and Doutre in Light Metals 1989, published by the Minerals, Metals and Materials Society in 1988 (pages 793 to 800) in which an impeller positioned at an angle within the furnace is used to stir the metal in a holding furnace. A chlorine gas is added though a hole in the shaft and is entrained by the circulating metal and dispersed in the furnace. The article "Improving Fluxing of Aluminum Alloys" by Beland et al in Light Metals 1995, published by the Minerals, Metals and Materials Society in 1995 (pages 1189 to 1195) discloses the addition of salt flux with stirring for treatment of metal in a furnace.

Treatment of molten aluminum using salt fluxes in crucibles (for example those used for transporting molten aluminum) has been proposed. Various rotary devices have been proposed for introducing solids and/or gases into molten metal in such crucibles to perform various treatments. European Application EP 0396267, published Nov. 7, 1990 describes a system for crucible fluxing using a rotary disperser on a vertically mounted shaft into which a gas/powder mixture is fed. The disperser includes an internal structure of compartments separated by blades. It has an open bottom and as such causes metal to be pumped through and ejected from the sides of the rotor.

Another form of device for dispersing flux in a molten metal bath is described in laid open Japanese Application 1988-193136, published Jul. 28, 1988. This includes an annular rotor on a vertically mounted shaft with mixing flutes on the outer periphery thereof.

European Application EP 0395138 published Oct. 31, 1990 describes another device for dispersing materials in molten metal using a rotary system. A salt/gas mixture is injected at the underside of a generally conical injector on a vertically mounted shaft having no blades or similar shearing devices.

Canadian Application CA 2,272,976, published Nov. 27, 1999 describes a system for treatment of smelter metal in transport crucibles to reduce alkalis, by using stirrers on vertically mounted shafts. Various stirrers are disclosed, with blades mounted on the underside of a conical hollow rotor, and also including vertical blades on a portion of the upper conical surface.

It is an object of the present invention to provide an improved rotary dispersing system for adding a powder/gas mixture to molten metal which is particularly well adapted for injecting a salt flux into molten aluminum in a melting or holding furnace.

SUMMARY OF THE INVENTION

According to one aspect of this invention there is provided an apparatus for the treatment of molten metal with a particulate treatment agent and a gas. This includes a vessel for holding molten metal, a rotary device for breaking up particulate treatment agent and gas within the molten metal and for dispersing particulate treatment agent and gas within the molten metal contained in the vessel and means for supplying the particulate treatment agent and gas to the rotary device. The rotary device comprises a hollow shaft having a rotor with an axial opening fixed to the discharge end of the shaft, this rotor comprising an annular plate with a plurality of radially mounted upwardly directed blades projecting from the top face of the annular plate and a plurality of radially mounted downwardly directed blades projecting from the bottom face of the annular plate.

According to a preferred feature of the invention the vessel is an aluminum melting or holding furnace and the rotary device is mounted on a carrier and can be moved in and out of an opening in the furnace. For use in this manner, the system is designed such that the rotary device can be operated with the axis of the hollow shaft at an angle of about 20–40° to the horizontal. The carrier may be fixed adjacent to a specific opening in the furnace made for access by the rotor and shaft or it can be a mobile unit and access to the furnace is made though the normal door used for charging such a furnace.

Regardless the orientation of the rotary device within the vessel, it will be understood that the top face of the annular plate with the upwardly projecting blades is the face adjacent the hollow shaft, while the bottom face of the plate with the downwardly projecting blades is the face opposite the top face.

It is particularly preferred that the apparatus be located within the furnace so that all parts of the rotor are located at least 30 cm from any interior surface of the furnace.

Particularly when it is desired to inject a solids/gas mixture at an angle as described above, special care is required to assure that proper mixing and dispersal of the solids/gas mixture takes place.

According to a further preferred embodiment of the invention, a further annular plate is fixed below the radially mounted blades that project downwardly from the first mentioned annular plate. Thus, the rotor comprises an upper annular plate and a lower annular plate with a plurality of radially mounted, upwardly directed blades projecting from the top face of the upper annular plate and a plurality of radially mounted blades fixed between the upper and lower annular plates.

The lower annular plate preferably has a central opening communicating with the interior between the two plates.

In both of the above embodiments of the invention, the upwardly projecting radially mounted blades serve an important function. Thus, the downwardly directed blades (or the blades between the annular plates) serve to create shear and thereby to break the gas into fine bubbles and the treatment agent into fine droplets or particles. However, it has been found that there is a tendency for the bubbles generated to form high concentrations in the periphery of the rotor, that coalesce and rise rapidly to the surface, carrying the particles or droplets of treatment agent with them, thus reducing the residence time of the treatment agent in the metal It has been found that by adding the set of upwardly directed radial blades to the rotor, a strong radial flow is generated, forcing the cloud of gas and treatment agent in a outward direction. The tendency to form high local concentrations is then reduced, increasing the average residence time of the treatment agent in the melt. These additional blades also increase the global circulation of liquid metal in the vessel.

In furnaces where the rotary device is mounted on a shaft, and the shaft is oriented at 20 to 40 degrees from the horizontal, it has been found that there is a tendency for the cloud of gas bubbles to be preferentially formed on the side of the rotor closest to the metal surface, and consequently the gas cloud, and associated treatment agent also rises more rapidly to the surface. The use of the further annular plate in accordance with one of the preferred embodiments can overcome this tendency and ensures that the cloud of gas bubbles is more uniformly dispersed around the rotor when configured in this manner.

Approximately 3–12 radially directed blades are mounted both above and below the annular plate and six blades on each location have been found to be optimum.

By being able to operate the system while mounted at an angle of about 20–40° to the horizontal, it has the particular advantage of being capable of insertion through an opening in the side of the furnace or, if operating as a mobile unit through a loading door in the furnace. A mobile unit furthermore, can be easily transported and operated at several furnaces in the cast house.

The treatment system of this invention is well adapted for use in large commercial furnaces, e.g. furnaces having capacities of 10–150 tons. In a typical operation, a salt flux is fed at a rate of 1 kg/min in 200 1/min of carrier gas.

The method and apparatus of the invention may be used to treat a variety of molten metals with a particulate treatment agent, for example aluminum and its alloys, magnesium and its alloys, etc. The gas that is used may be inert or it may be reactive to the metal being treated. Examples of gases that may be used include chlorine, argon and nitrogen.

Examples of treatment agents which may be used in particulate form include fluxing agents such as mixtures of alkali metal chlorides for treating aluminum or its alloys, grain refiners, etc.

BRIEF DESCRIPTION OF THE DRAWING

The invention is illustrated by way of example with reference to the accompanying drawings in which:

Referring to FIG. 1, an aluminum melting furnace 10 has a side opening 11 and contains a bath of molten aluminum 12 with a melt surface 13. Extending through the opening 11 is a hollow rotor shaft 15 having mounted on the end thereof a rotor 16 for dispersing a solids/gas mixture into the molten metal bath 12.

Figure 1:
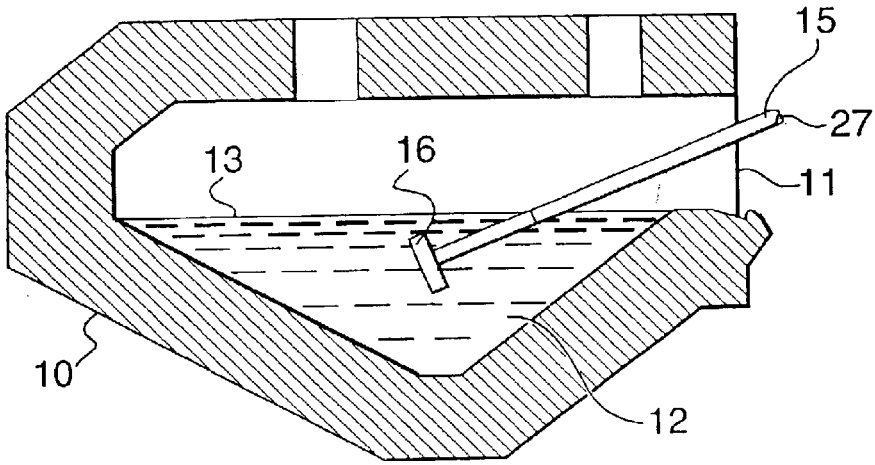
FIG. 1 is a sectional view of an aluminum-melting furnace with the injector of the invention.
Figure 2:
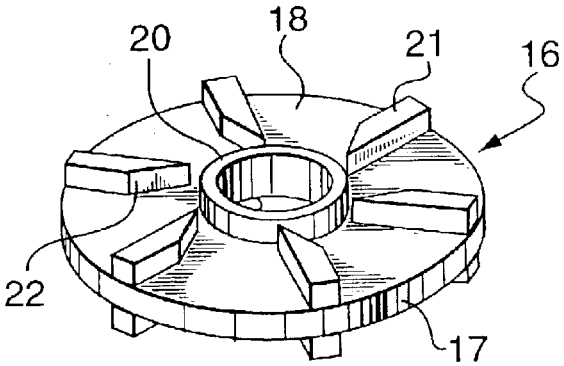
FIG. 2 is an isometric view of one rotor embodiment.
Figure 3:
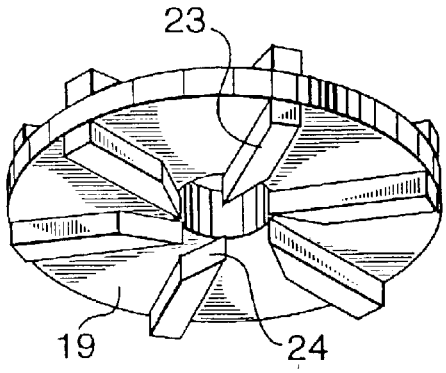
FIG. 3 is a further isometric view of the rotor of FIG. 2.
Figure 4:
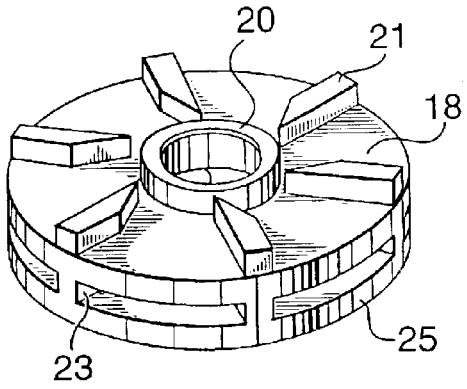
FIG. 4 is an isometric view of a further rotor embodiment.
Figure 5:
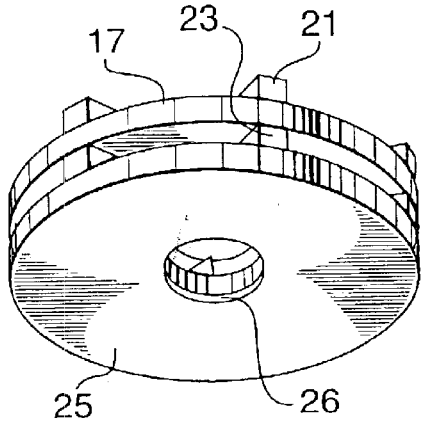
FIG. 5 is a further isometric view of the rotor of FIG. 4.
Figure 6:
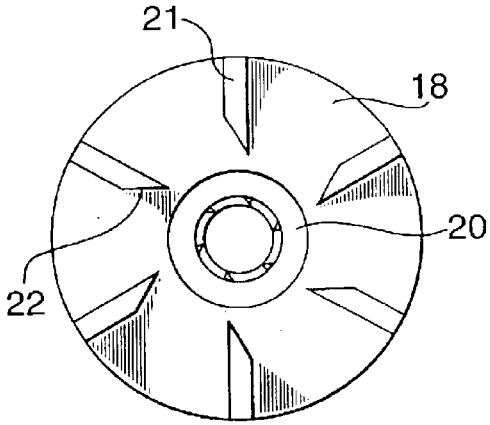
FIG. 6 is a top plan view of the rotor of FIG. 4.

One embodiment of the rotor is shown in greater detail in FIGS. 2 and 3. It comprises an annular plate 17, typically about 40 cm in diameter, having an axial opening surrounded by a collar 20 for mounting to hollow shaft 15. The plate 17 has an upper face 18 and a lower face 19. Fixed on upper face 18 are a plurality of radially mounted blades 21 having tapered inner end faces 22. The inner ends of these blades are preferable terminated at a radial distance greater than the radius of the collar 20 to provide an annular gap between the collar and the inner edges of the blades. Fixed to the lower face of plate 17 are a further series of radially mounted blades 23 having tapered inner end faces 24. The rotor, in use, is preferably rotated so that the tapered inner end faces 22 are on the side of the blades opposite the direction of rotation.

With this rotor arrangement the solids/gas mixture pass down through the hollow core 27 of shaft 15 and through collar opening 20 at which point the lower blades 23 serve to mix the solids/gas mixture with the molten metal. Where the solid is a salt flux, it is molten by the point at which it enters the molten aluminum and is readily sheared into small droplets by the blades 23 to effectively distribute them. Because there is a tendency for a cloud of bubbles to be formed by the lower shearing blades 23, and for the treatment agent to remain associated with the cloud of bubbles, the upper blades 21 represent an essential component of the invention. Thus, the upper blades create a secondary mixing of the molten aluminum that serves to disperse any clouds of bubbles that emerge from the region beneath plate 17.

Figure 7:
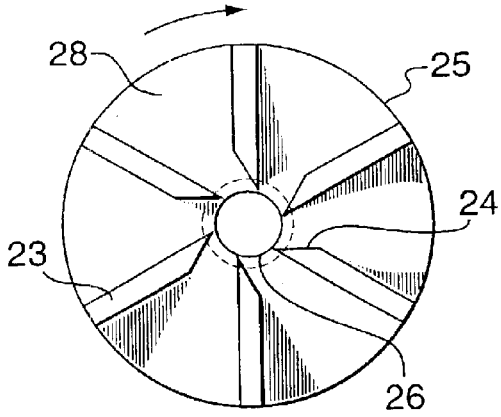
FIG. 7 is a sectional view through the rotor of FIG. 4.
Figure 8:
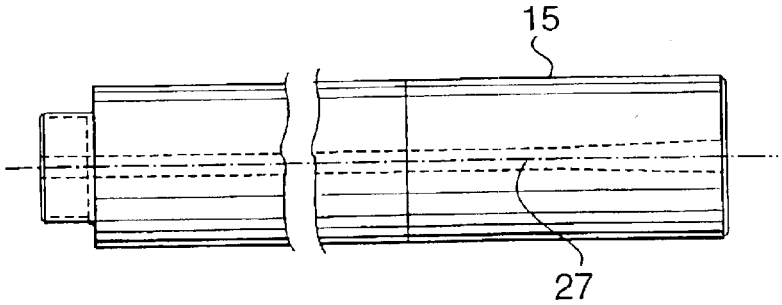
FIG. 8 is a plan view of the hollow rotor shaft.

A preferred embodiment of the invention is illustrated by FIGS. 4 to 7. In this embodiment, a second annular plate 25 is mounted directly beneath the lower blades 23, thus creating segment shaped passageways 28 between the plates 17 and 25 and between adjacent radially mounted shearing blades 23 as can be seen in FIG. 7. The two annular plates are preferably spaced apart by a distance of from about 12 to 75 mm. This provides a more efficient dispersal of the solids/gas mixture into the molten metal, particular when the rotor is mounted on a shaft whose axis is mounted at the preferred angle of 20 to 40 degrees from the horizontal.

With this arrangement, the molten metal is drawn upwardly through the axial hole 26 in bottom annular plate 25 where it engages the solids/gas mixture travelling down axial opening 27 of shaft 15 with this mixture being dispersed outwardly through the cavities 28 into the main molten bath 12. With this arrangement, the upper mixing blades 21 remain necessary for the purpose of efficiently dispersing clouds of bubbles that still emerge into the bath.

Figure 9:
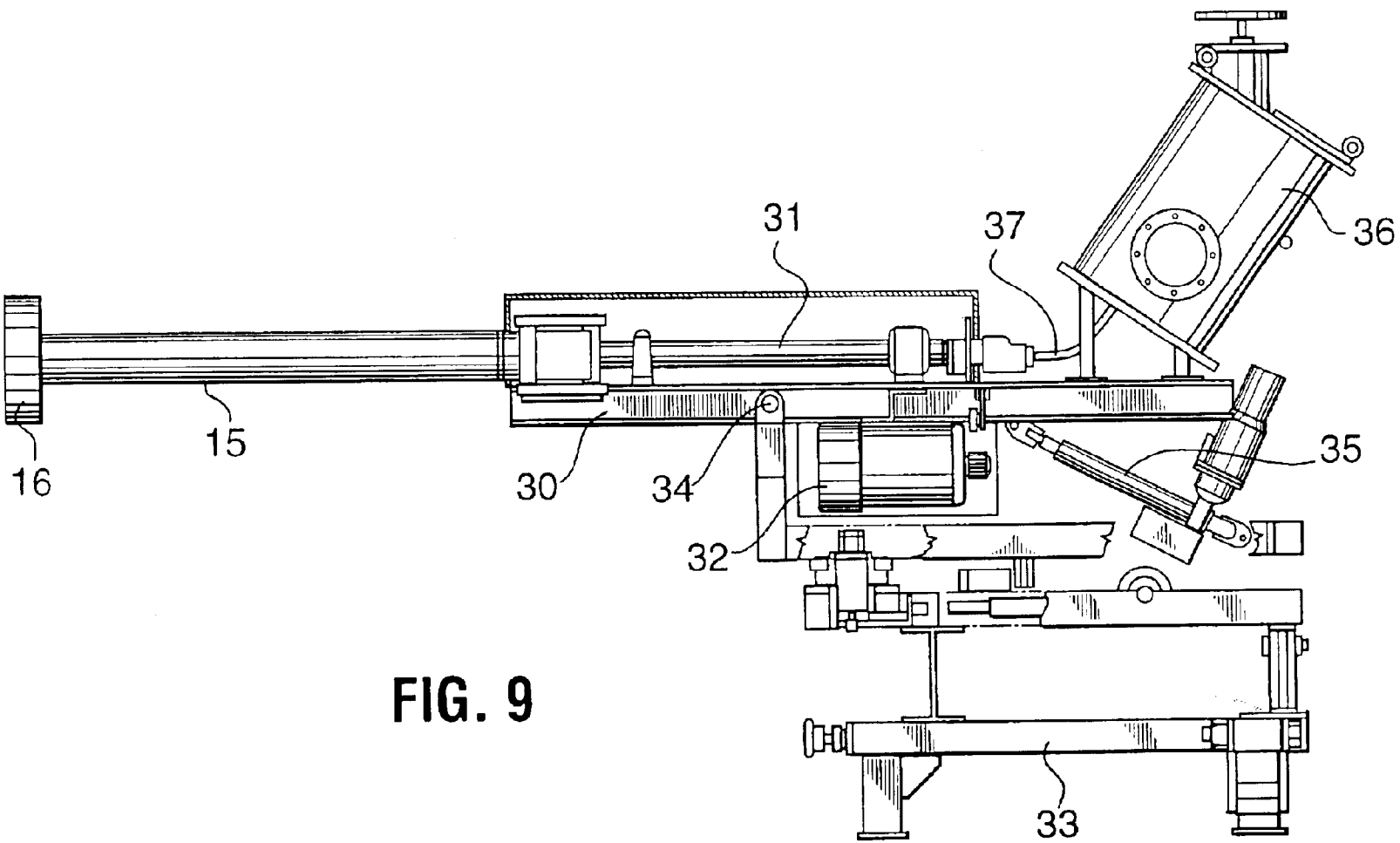
FIG. 9 is an elevation view of a support frame adapt to carry the rotor.

A support assembly for carrying the rotor 16 and hollow shaft 15 is shown in FIG. 9. This assembly may be conveniently operated as a mobile unit with the rotor passing through a loading door in the furnace or as a fixed unit with the rotor passing through an opening in the side of the furnace. The hollow shaft 15 is connected to a hollow drive shaft 31 which is mounted for rotation on a support 30. This support 30 is pivotally connected by way of pivot 34 to a support frame 33. A tilting mechanism 35 tilts the hollow shaft to the desired angle of 20–40° to the horizontal when in use.

Figure 10:
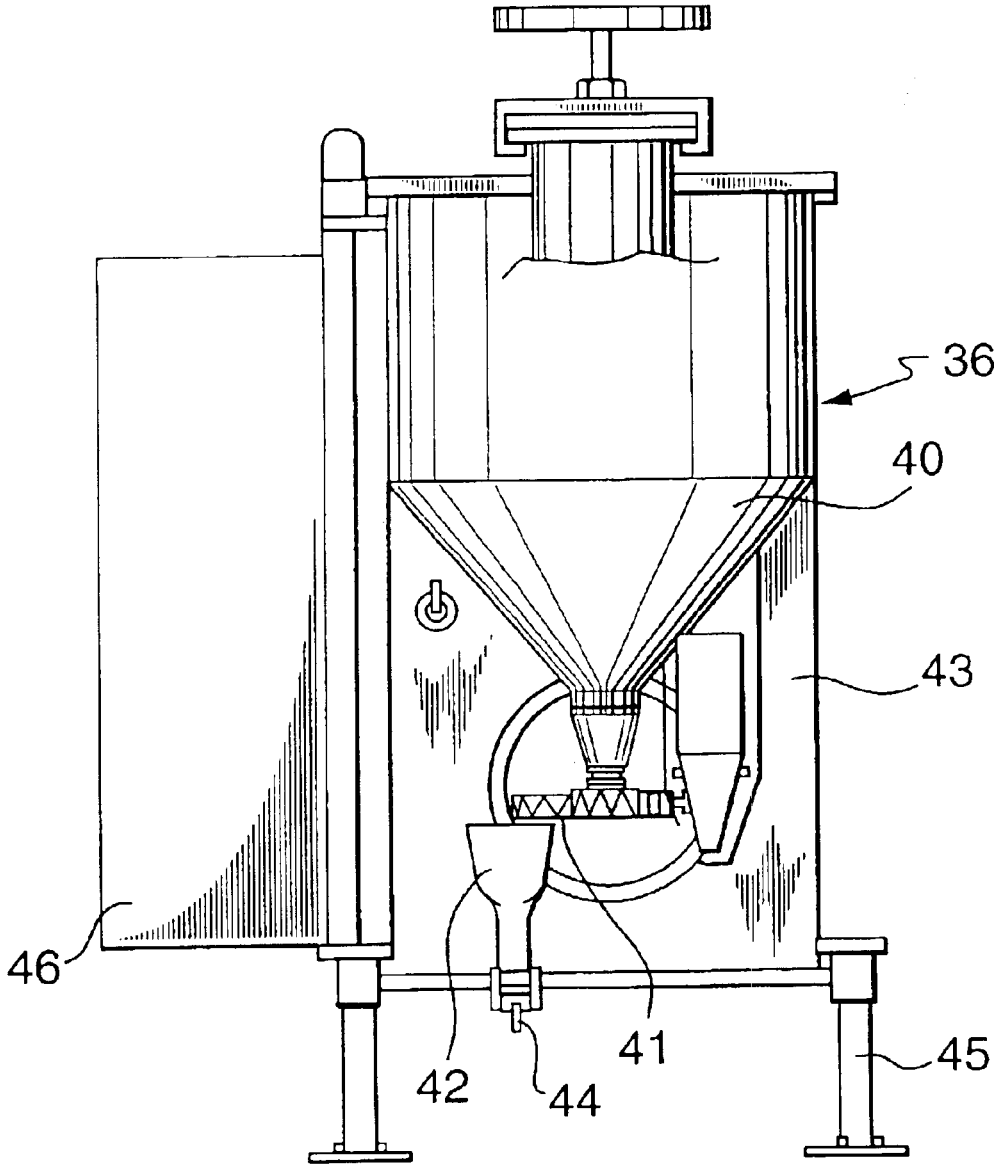
FIG. 10 is an elevation view of a unit for supplying a solids/gas mixture to the rotor.

An assembly 36 for mixing and feeding a solids/gas mixture is also mounted on pivotal support 30 and is connected to hollow drive shaft 31 by way of flexible tube 37. This assembly 36, as shown in FIG. 10, includes a hopper 40 for particulate solids materials, which feeds into a screw feed 41 and thence into funnel 42 having an outlet 44 connecting to flexible tube 37. A sealed enclosure 43 is charged with the desired gas and the gas feeds through funnel together with the particulate.

The assembly is supported by legs 45 and includes a control panel 46.

The present invention is useful for efficiently reducing alkali metals and particulate in large aluminum melting and holding furnaces. In comparative tests, it has been found that the apparatus can reduce Ca and Na levels by 37 and 30% respectively compared to a simple impeller design as previously used. This permits reduction of fluxing times by a similar amount. Particulate removal rates are at least as good as those obtained using the simple impeller design.

What is claimed is:

1. Apparatus for the treatment of molten metal with a particulate treatment agent and a gas, comprising a melting or holding furnace for molten metal, a rotary device for breaking up particulate treatment agent and gas within molten metal, and for dispersing particulate treatment agent and gas within molten metal within the vessel and means for supplying the particulate treatment agent and gas to the rotary device, wherein the rotary device comprises a hollow shaft mounted at an angle to the horizontal and extending through an opening in a side of the furnace, said hollow shaft having a rotor with an axial opening fixed to the discharge end thereof, said rotor comprising an annular plate with a plurality of radially mounted, upwardly directed blades projecting from the top face of the annular plate and a plurality of radially mounted downwardly directed blades projecting from the bottom face of the annular plate.

2. Apparatus for the treatment of molten metal with a particulate treatment agent and a gas, comprising a melting or holding furnace for molten metal, a rotary device for breaking up particulate treatment agent and gas within molten metal, and for dispersing particulate treatment agent and gas within molten metal within the vessel and means for supplying the particulate treatment agent and gas to the rotary device, wherein the rotary device comprises a hollow shaft mounted at an angle to the horizontal and extending through a loading door of the furnace or an opening in a side of the furnace, said hollow shaft having a rotor with an axial opening fixed to the discharge end thereof, said rotor comprising an annular plate with a plurality of radially mounted, upwardly directed blades projecting from the top face of the annular plate and a plurality of radially mounted downwardly directed blades projecting from the bottom face of the annular plate, and wherein the rotary device is mounted within the furnace with the axis of the hollow shaft at an angle to the horizontal of about 20–40°.

3. An apparatus according to claim 2 installed in a furnace having a capacity of about 10–150 tons.

4. An apparatus according to claim 2 wherein the annular plate has 3–12 downwardly directed blades and 3–12 upwardly directed blades.

5. An apparatus according to claim 4 having six blades on said bottom face and six blades on said top face.

6. An apparatus according to claim 4 wherein the outer ends of the radially mounted blades do not project beyond the outer periphery of the annular plate.

7. An apparatus according to claim 1 wherein a further annular plate is fixed below the radially mounted blades that project downwardly from the said annular plate.

8. Apparatus for the treatment of molten metal with a particulate treatment agent and a gas, comprising a melting or holding furnace for molten metal, a rotary device for breaking up particulate treatment agent and gas within molten metal, and for dispersing particulate treatment agent and gas within molten metal within the vessel and means for supplying the particulate treatment agent and gas to the rotary device, wherein the rotary device comprises a hollow shaft mounted at an angle to the horizontal and extending through an opening in a side of the furnace, said hollow shaft having a rotor with an axial opening fixed to the discharge end thereof, said rotor comprising an upper annular plate and a lower annular plate with a plurality of radially mounted, upwardly directed blades projecting from the top face of the upper annular plate and a plurality of radially mounted blades fixed between said upper and lower annular plates, whereby the particulate treatment agent and gas are discharged between the annular plates.

9. Apparatus for the treatment of molten metal with a particulate treatment agent and a gas, comprising a melting or holding furnace for molten metal, a rotary device for breaking up particulate treatment agent and gas within molten metal, and for dispersing particulate treatment agent and gas within molten metal within the vessel and means for supplying the particulate treatment agent and gas to the rotary device, wherein the rotary device comprises a hollow shaft mounted at an angle to the horizontal and extending through a loading door of the furnace or an opening in a side of the furnace, said hollow shaft having a rotor with an axial opening fixed to the discharge end thereof, said rotor comprising an upper annular plate and a lower annular plate with a plurality of radially mounted, upwardly directed blades projecting from the top face of the upper annular plate and a plurality of radially mounted blades fixed between said upper and lower annular plates, whereby the particulate treatment agent and gas are discharged between the annular elates, and wherein the furnace is an aluminum melting and holding furnace and the rotary device is mounted within the furnace at an angle to the horizontal of about 20–40°.

10. An apparatus according to claim 9 installed in a furnace having a capacity of about 10–150 tons.

11. An apparatus according to claim 9 wherein the upper annular plate has 3–12 upwardly directed blades and 3–12 shearing blades are mounted between the annular plates.

12. An apparatus according to claim 11 having six blades on the top face of the upper annular plate and six blades between the upper and lower annular plates.

13. An apparatus according to claim 11 wherein the outer ends of the radially mounted blades do not project beyond the outer periphery of the annular plates.

14. A process for the treatment of molten metal with a particulate treatment agent and a gas which comprises providing a rotary device comprising a hollow shaft having a discharge end and an annular rotor attached to the shaft, the rotor having a plurality of radially mounted upwardly directed blades and a plurality of radially mounted downwardly directed blades, extending the annular rotor and hollow shaft into a melting or holding furnace for molten metal with the hollow shaft at an angle to the horizontal and extending through an opening in a side of the furnace and with the annular rotor immersed in molten metal contained in a vessel, rotating the device while feeding particulate treatment agent and gas down through the hollow shaft whereby the particulate treatment agent and gas enter the molten metal beneath the rotor and are broken into droplets and finer particles and dispersed within the molten metal by the shearing action of the downwardly directed blades and further mixing the molten metal by the action of the upwardly directed blades whereby clouds of bubbles formed by action of the downwardly directed blades are dispersed within the molten metal.

15. A process according to claim 14 wherein the annular rotor includes a further annular plate fixed below the radially mounted blades that project downwardly from said annular plate and the particulate treatment agent and gas are delivered to the molten metal through segment shaped cavities formed between the annular plates and radially mounted blades.

16. A process for the treatment of molten metal with a particulate treatment agent and a gas which comprises providing a rotary device comprising a hollow shaft having a discharge end and an annular rotor attached to the shaft, the rotor having a plurality of radially mounted upwardly directed blades and a plurality of radially mounted downwardly directed blades, extending the annular rotor and hollow shaft into a melting or holding furnace for molten metal with the hollow shaft at an angle to the horizontal and extending through a loading door of the furnace or an opening in a side of the furnace and with the annular rotor immersed in molten metal contained in a vessel, rotating the device while feeding particulate treatment agent and gas down through the hollow shaft whereby the particulate treatment agent and gas enter the molten metal beneath the rotor and are broken into droplets and finer particles and dispersed within the molten metal by the shearing action of the downwardly directed blades and further mixing the molten metal by the action of the upwardly directed blades whereby clouds of bubbles formed by action of the downwardly directed blades are dispersed within the molten metal, and wherein the rotor is operated within the furnace with the axis of the hollow shaft at an angle to the horizontal of about 20–40°.

17. A process according to claim 16 wherein the rotor is operated within the furnace such that all parts of the rotor are located at least 30 cm from any interior surface of the furnace.

18. A process according to claim 17 wherein the molten metal is aluminum or an alloy thereof and the particulate treatment agent is a salt flux.

19. A process according to claim 18 wherein the salt flux is molten by the point at which it enters the molten aluminum.

* * * * *